US005860867A

United States Patent [19]

Van Deusen

[11] Patent Number: 5,860,867

[45] Date of Patent: Jan. 19, 1999

[54] INTERLOCKING PLAYGROUND SLIDE SECTIONS

[75] Inventor: Gary Van Deusen, Hillsdale, Mich.

[73] Assignee: The Shane Group, Inc., Hillsdale, Mich.

[21] Appl. No.: 26,663

[22] Filed: Feb. 20, 1998

[51] Int. Cl.[6] ..... A63G 21/00

[52] U.S. Cl. ..... 472/116; 472/88

[58] Field of Search ..... 472/88, 89, 116, 472/117; 104/69, 70; 482/35, 36; D21/244; 446/127; 52/588.1, 591.1, 592.1, 578, 579

[56] References Cited

U.S. PATENT DOCUMENTS

| | | | |
|---|---|---|---|
| 3,302,949 | 2/1967 | Wolfe | 472/13 |
| 3,831,934 | 8/1974 | Hancovsky | 472/116 |
| 4,270,748 | 6/1981 | Ray | 472/116 |
| 4,721,299 | 1/1988 | Schlientz | 472/116 |
| 4,893,807 | 1/1990 | Ahrens | 472/116 |
| 4,932,648 | 6/1990 | Ahrens | 472/116 |
| 4,943,048 | 7/1990 | Hentges | 472/116 |
| 5,387,158 | 2/1995 | Bertrand | 472/117 |
| 5,427,574 | 6/1995 | Donnelly-Weide | 472/116 |

*Primary Examiner*—Kien T. Nguyen
*Attorney, Agent, or Firm*—Young & Basile, P.C.

[57] ABSTRACT

A connection for interconnecting adjacent playground slide sections in end-to-end relationship wherein slide sections formed of molded synthetic material will be accurately aligned and the fasteners holding the sections together are recessed and do not interfere with the sliding surfaces. The interconnection utilizes a projection received within a complementary recess in an overlapping manner to produce a smooth aligned sliding surface relationship between adjacent slide sections capable of producing a high strength fastener produced connection.

7 Claims, 1 Drawing Sheet

INTERLOCKING PLAYGROUND SLIDE SECTIONS

BACKGROUND OF THE INVENTION

1. Field of the Invention

The invention pertains to the field of playground slides, and particularly to the interconnection for adjacent slide sections whereby the sliding surfaces are accurately aligned in end-to-end relationship while adjacent sections include overlapping portions interconnected by fasteners to achieve maximum strength.

2. Description of the Related Art

Playground slides, whether formed of metal or synthetic plastic, often consist of several elongated sections interconnected at their ends. The forming of the slide in sections simplifies shipping, and permits various configurations to be introduced into the slide if it is desired that the occupant pass through turns or curves during descent.

Forming the playground slide of a plurality of interconnected sections requires an interconnection between adjacent sections, and the simplest interconnection is to overlap the sliding surfaces of adjacent sections, the upper section overlapping the lower section, and fasteners such as rivets, bolts or screws may extend through the section overlapped portions having heads which are flush, or substantially flush, with the upper sliding surface. Such an interconnection between the slide sections is simple and strong, but produces a slight bump as the sections overlap, and expose the slider to possible injury if a fastener loosens and extends above the sliding surface.

In order to alleviate the aforementioned problems of overlapping slide section interconnections, a variety of proposals have been advanced to maintain the adjacent sliding surfaces in alignment thereby avoiding the bump at the section joint, and by forming each slide section end with a flange perpendicularly disposed to the sliding surface, fasteners may extend through the flanges to maintain the slide sections in alignment and end-to-end relationship. This arrangement has the advantage of removing the fasteners from possibly injuring the slider, but the fasteners are exposed to possible vandalism, and the appearance of the slide is adversely affected by the rather large flanges extending from the slide sections.

Previously, a playground slide interconnection for use with either metal or synthetic slide sections has not been available whereby the sections may be maintained in an abutting end-to-end sliding surface aligned relationship, the fasteners being protected from vandalism, and the interconnection being of such a configuration as to be aesthetically superior and not detract from the overall slide appearance.

Objects of the Invention

It is an object of the invention to provide an interconnection for playground slide sections wherein the sections' sliding surfaces will attractively abut in aligned end-to-end relationship and wherein the fasteners maintaining the interconnection are substantially concealed and not readily accessible to vandals.

Another object of the invention is to provide an interconnection for playground slide sections wherein the sections' sliding surfaces will be maintained in aligned end-to-end abutting relationships but the strength of an overlapped relationship between adjacent slide sections using fasteners is provided.

An additional object of the invention is to provide an interconnection for playground slides wherein the sections' sliding surfaces are maintained in an aligned abutting end-to-end relationship eliminating bumps and the alignment of interconnected sections is achieved by nesting alignment and fastener receiving surfaces overlapping with respect to each other.

Yet a further object of the invention is to provide an interconnection for playground slide sections wherein the ends of the sections are maintained in aligned end-to-end relationship and the alignment is quickly achieved during assembly by the use of overlapped nesting alignment and fastener receiving portions through which threaded fasteners extend, and the fasteners are enclosed within slide section structure as to not be readily susceptible to vandalism.

Summary of the Invention

While the inventive concepts may be used with playground slide sections either formed of metal or molded of a synthetic plastic material, the inventive concepts are particularly suitable for use with molded synthetic slide sections, and are described in such an embodiment in the following specification.

The interconnection of the invention is utilized in a playground slide having at least two sections. Playground slides may include a plurality of sections depending upon their length and configuration. The sections may be linear in a straight slide, or may be curved wherein the slider will change direction during the slide. It is also common to form the slide as a spiral wherein the slider will be translated through 1800, or more, during the descent. The concepts of the invention may be employed with any configuration of playground slide section, it only being necessary that the adjacent slide section interconnected thereto has a corresponding interconnection configuration to permit the interconnection of adjacent sections.

The playground slide interconnection includes a male end or configuration which constitutes a projection from the end of the associated slide section. The innermost portion of the projection is defined by a sliding surface which may include both the bottom surface of the slide and the side surfaces, all of which are exposed to the slide occupant. The projection ends in a terminating abutment surface perpendicularly disposed to the adjacent sliding surfaces, and the terminating abutment surface extends outwardly away from the sliding surfaces to intersect with an alignment and fastener receiving surface extending rearwardly from the terminating abutment surface and spaced from the projection slide surface. In this manner, the projection is a hollow box-like configuration and the alignment and fastener receiving surface terminates in a shoulder intersecting the outermost portion of the associated slide section. Preferably, the projection alignment and fastener receiving surface includes a V-shaped channel and threaded inserts are molded into the V-shaped channel for receiving threaded fasteners as later described.

The playground slide section male end projection is received within a playground slide female end which constitutes a recess of a configuration complementary to the configuration of the slide section male projection. Accordingly, the slide section female end includes a shoulder adapted to engage the male section shoulder, an alignment and fastener receiving surface, preferably of a V-shaped channel configuration complementary to the alignment and fastener receiving portion of the projection, and a shoulder abutment surface extends from the recess alignment and fastener receiving surfaces in a manner perpendicular to the sliding surfaces of the associated slide section. Accordingly, the terminating abutment surface of the projection will abuttingly engage the shoulder abutting surface of the recess and the dimension of these abutting surfaces perpendicular to the slider engaging surfaces is such that the sections' sliding engaging surfaces will be in alignment and no bump will exist at the joint line between the interconnected slide sections.

Because the alignment and fastener receiving surfaces of the projection and recess closely nest together in an overlapped relationship with respect to the length of the slide sections, the slide sections will be accurately aligned with respect to each other, and threaded fasteners extending through the recess alignment and fastener receiving surfaces received within the threaded inserts molded into the projection will maintain the interconnection of the slide sections upon tightening of the fasteners.

The outermost surface of the slide section ends defining the recess are provided with holes for receiving the threaded fasteners, and upon tightening of the fasteners, the heads thereof will be located within the hollow box-like configuration of the section material defining the recess and not readily visible to potential vandals. Also, by utilizing unusual sockets or fastener head configurations, unauthorized removal of the fasteners is discouraged.

As the projection on the male end of the playground slide section and the recess defined on the end of the female slide projection overlap, the advantages of the high strength of an overlapping interconnection are achieved, but because of the hollow box-like configuration of the projection and recess, the fasteners do not extend through the sliding surfaces and cannot become a hazard to sliders even though the fasteners may inadvertently loosen.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figure 1:
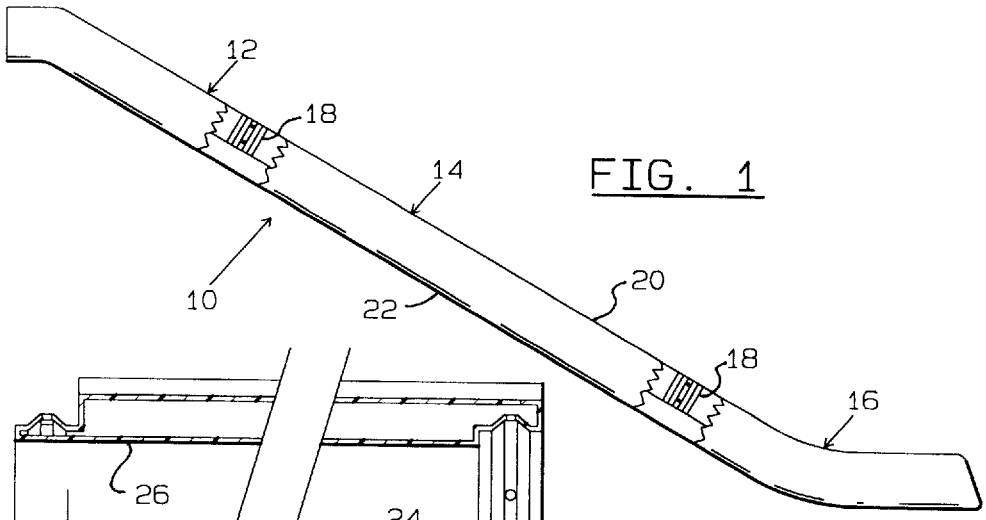
FIG. 1 is a side elevational view, partially sectioned, illustrating a three section playground slide incorporating the inventive concepts.

With respect to FIG. 1, a typical playground slide 10 is illustrated consisting of a top section 12, a middle section 14 and a lower section 16. In the illustrated embodiment, all of the sections are generally linear in a plan view, and the upper end of the top section 12 will normally be connected to a ladder or platform, not shown, while the lower horizontal portion of lower section 16 is usually supported by legs, not shown. Section 12 is connected to the upper end of section 14 by the interconnection 18, while the lower end of section 14 is connected to the upper end of lower section 16 by a similar interconnection 18.

The upper edge of the slide 10 is represented at 20, while the bottom edge of the sides of the slide are represented at 22. The sliding surface bearing the weight of the slider is shown at 24, and on each side of the slide surface 24, a vertically disposed side slide surface 26 is located. It is important that the surfaces 24 and 26 throughout their entire length be free of obstructions or protuberances capable of injuring the sliding occupant, and it is also important that the respective surfaces 24 and 26 of the adjacent sections engage each other in accurate alignment so as to produce as smooth a "ride" as possible.

The interconnections 18 each consist of a male element and a female element. The elements are of a complementary configuration so as to closely conform to each other producing a "line" joint wherein adjacent slide section surfaces are in accurate alignment free of protuberances.

Figure 2:
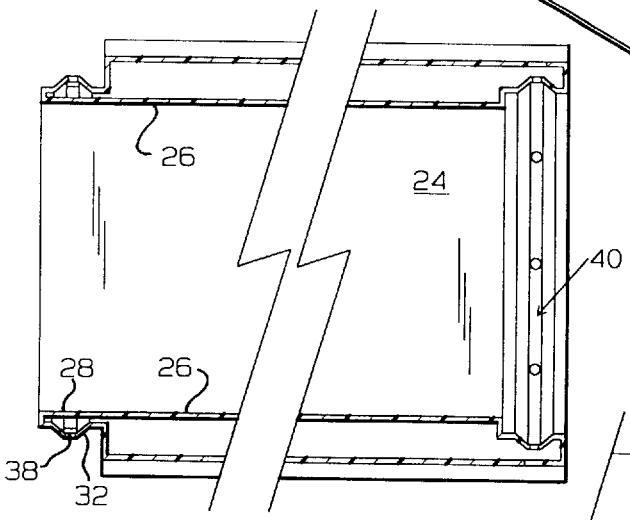
FIG. 2 is a plan view of a playground slide section, broken in length, illustrating the configurations of the male and female ends.
Figure 4:
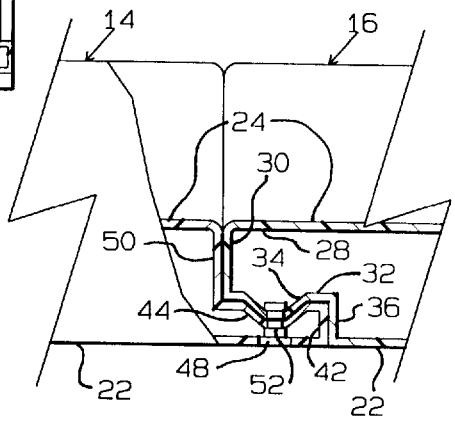
FIG. 4 is a detailed elevational view, partially in section, showing the assembly of the male and female ends of a playground slide in accord with the invention.
Figure 3:
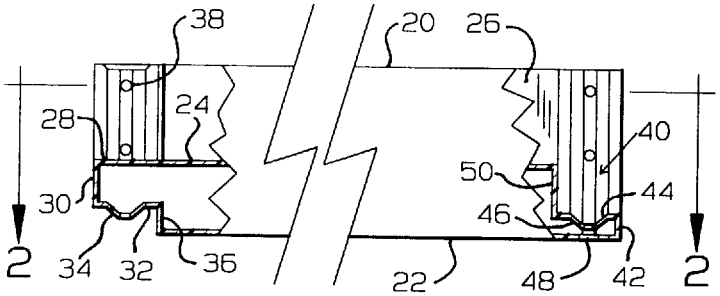
FIG. 3 is an elevational sectional view of a playground slide utilizing the concepts of the invention, broken in length, illustrating the configuration of the male and female ends.

The male end of a slide section consists of the projection 28, FIGS. 2 and 4, which is defined at its innermost by the slide surfaces 24 and 26. The end of the projection 28 is defined by the terminating abutment surface 30 which is flat and perpendicularly related to the surfaces 24 and 26. The terminating abutment surface 30, in an outer direction, intersects the projection alignment and fastener surfaces 32 which are of a V-channel configuration 34 and generally extend toward the body of the associated slide section. Inwardly, the projection 28 is defined by the shoulder 36 consisting of a surface parallel and spaced inwardly from the terminating abutment 30. When the slide section is molded of a synthetic plastic material, such as reinforced glass fiber resin, or the like, threaded inserts 38, shown in FIGS. 2 and 4, are molded into the apex of the V-channel 34 for receiving threaded fasteners as later described. As will be appreciated from the drawings, the construction of the projections 28 results in a hollow box-like form which is thicker adjacent surface 24 than at the side surfaces 26.

The female portion of the interconnection 18 is defined by the recess 40 adjacent the outer shoulder surface 42 defining the end of the associated slide section at the recess 40. An alignment and fastener receiving portion 44 is defined in the recess 40 adjacent the shoulder 42 and this portion includes the V-channels 46 which are of the same configuration and shape as the V-channels 34. A plurality of spaced holes are defined in the apex of the V-channel 46, the holes being spaced and located commensurate to the inserts 38, and the recess 40 includes the flat shoulder abutment surface 50 which is parallel to the shoulder 42 and perpendicular to the sliding surfaces of the associated slide section.

The slide section adjacent recess 40 will also be of a hollow box-like form and the bottom 22 and sides of the slide will be formed with holes 48 which are in alignment with the holes in V-22 channel 46 and the inserts 38.

To assemble interconnected slide sections, the male end of the section as defined by the projection 28 is placed within the section female end as defined by the recess 40. The terminating abutment surface 30 is brought into engagement with the shoulder abutment surface 50 as shown in FIG. 4. In this relationship, the projection V-channel 34 will be closely received within the recess V-channel 46 as the projection alignment and fastener surfaces 32 closely engage the recess alignment and fastener surfaces 44. As will be appreciated from FIG. 4, the dimensions of the hollow box-like projection 28 and the similar hollow recess 40 are such that the vertical dimensions of the terminating abutment surface 30 and the shoulder abutment surface 50 engage so that the aligned slide surfaces 24 and 26, respectively, of interconnected sections align, FIG. 4, to produce a smooth sliding surface from one section to the other.

Once the projection 28 is fully received within the recess 40, screws 52, FIG. 4, are inserted through holes 48 and threaded into inserts 38. In this manner, the overlapping projection 28 and recess 40 are firmly interconnected to mechanically attach adjacent slide sections. The screws 52 will maintain the surfaces 32 and 44, and the V-channels 34 and 46 in a tight contiguous manner producing a high strength connection between adjacent slide sections.

Because the screws 52 are inserted into the inserts 38 through holes 48 defined in the bottoms 22 of the sections, the screws 52 do not protrude from the configuration of the slide sections, and are not readily accessible to vandalism. Preferably, the heads of the screws 52 are of the "Allen" type using a uniquely shaped socket, rather than a hexagonal socket, as to require a special wrench tool to rotate the screw. Such type of wrench will discourage vandalism with respect to removal of the screws 52.

The described interconnection 18 between adjacent slide sections results in a high strength, smooth and aesthetically attractive interconnection for playground slides, and it is appreciated that various modifications to the inventive concepts may be apparent to those skilled in the art without departing from the spirit and scope of the invention.

I claim:

1. An interconnection for connecting elongated sections of playground slides in end-to-end relationship comprising, in combination, a first slide section male end having bottom and side portions each forming slide defining surfaces, a projection defined on said male section end extending in the direction of the length of the associated section, said projection including a terminating abutment surface perpendicularly intersecting said slide defining surfaces of the associated section, said projection including a first alignment and fastener receiving portion intersecting and longitudinally set back from said terminating abutment surface and spaced from the associated slide defining surfaces, a second slide section female end adapted to connect to said first end having bottom and side portions each forming slide defining surfaces, a recess defined in said female section end adapted to receive said projection defined on said male section end, said recess including a shoulder abutment surface perpendicularly intersecting said slide defining surfaces of the associated section adapted to engage said projection terminating abutment surface, said recess including a second alignment and fastener receiving portion longitudinally set outwardly from said abutment surface, and spaced from the associated slide defining surfaces, said second alignment and fastener receiving portion corresponding in configuration to said first alignment and fastener receiving portion and closely receiving said first alignment and fastener receiving portion upon said terminating abutment surface abutting said shoulder abutment surface, and a plurality of fasteners interconnecting said first and second alignment end fastener receiving portions together.

2. An interconnection for connecting playground slide sections as in claim 1, said first and second alignment and fastener receiver portions each including complementary V-shaped channels which nest together upon said terminal and shoulder abutment surfaces engaging.

3. An interconnection for connecting playground slide sections as in claim 2, said fasteners being located within and extending through said V-shaped channels.

4. An interconnection for connecting playground slide sections as in claim 1, said slide sections being molded of synthetic plastic material.

5. An interconnection for connecting elongated molded sections of playground slides formed of synthetic material in end-to-end relationship comprising, in combination, a first slide section male end having a hollow form defining a projection having an upper sliding surface, a lower alignment and fastener receiving surface spaced from said sliding surface and a terminating abutment surface defining the end of said projection extending between said upper and lower surfaces, a second slide section female end having a hollow form defining a recess complementary in configuration to and receiving said projection having a shoulder abutment surface and an alignment and fastener surface complementary to said lower projection alignment and fastener receiving surface, said terminating abutment surface and said shoulder abutment surfaces engaging and said projection lower alignment and fastener receiving surface closely engaging said recess alignment and fastener surface upon said projection being located within said recess, a plurality of threaded inserts molded into said projection lower alignment and fastener receiving surface and a plurality of threaded fasteners extending through said recess alignment and fastener receiving surface threaded into said inserts to connect adjacent slide sections.

6. An interconnection for connecting playground slide sections as in claim 5, said projection lower alignment and fastener receiving surface and said recess alignment and fastener surface each including complementary V-shaped channels which nest together upon said terminal and shoulder abutment surfaces engaging.

7. An interconnection for connecting playground slide sections as in claim 6, said inserts and said fasteners being located within said V-shaped channels.

* * * * *